US008056432B2

(12) United States Patent
Hanlon et al.

(10) Patent No.: US 8,056,432 B2
(45) Date of Patent: Nov. 15, 2011

(54) ACTIVE CONTROL STICK ASSEMBLY

(75) Inventors: Casey Hanlon, Queen Creek, AZ (US); Calvin C. Potter, Mesa, AZ (US); Paul T. Wingett, Mesa, AZ (US)

(73) Assignee: Honeywell International Inc., Morristown, NJ (US)

( * ) Notice: Subject to any disclaimer, the term of this patent is extended or adjusted under 35 U.S.C. 154(b) by 566 days.

(21) Appl. No.: 12/234,262

(22) Filed: Sep. 19, 2008

(65) Prior Publication Data

US 2010/0071496 A1 Mar. 25, 2010

(51) Int. Cl.
*G05G 9/047* (2006.01)

(52) U.S. Cl. ..... 74/471 XY

(58) Field of Classification Search ..... 74/471 XY
See application file for complete search history.

(56) References Cited

U.S. PATENT DOCUMENTS

| | | | | |
|---|---|---|---|---|
| 3,585,319 | A | 6/1971 | Payerle et al. | |
| 3,707,093 | A | 12/1972 | Worden | |
| 4,124,787 | A * | 11/1978 | Aamoth et al. | 200/6 A |
| 4,533,899 | A | 8/1985 | Isaksson | |
| 4,962,448 | A | 10/1990 | DeMaio et al. | |
| 5,223,776 | A | 6/1993 | Radke et al. | |
| 5,228,356 | A | 7/1993 | Chuang | |
| 5,513,100 | A | 4/1996 | Parker et al. | |
| 6,030,291 | A | 2/2000 | Maki et al. | |
| 6,128,970 | A | 10/2000 | Kim | |
| 6,329,812 | B1 | 12/2001 | Sundin | |
| 6,639,581 | B1 | 10/2003 | Moore et al. | |
| 6,859,198 | B2 | 2/2005 | Onodera et al. | |
| 6,966,397 | B2 | 11/2005 | Yanaka | |
| 2002/0007690 | A1 | 1/2002 | Song et al. | |
| 2005/0073496 | A1 | 4/2005 | Moore et al. | |
| 2006/0283279 | A1 * | 12/2006 | Levin et al. | 74/471 XY |

FOREIGN PATENT DOCUMENTS

WO WO 2007141894 A1 * 12/2007

* cited by examiner

*Primary Examiner* — Thomas R Hannon
*Assistant Examiner* — Phillip A Johnson
(74) *Attorney, Agent, or Firm* — Ingrassia Fisher & Lorenz P.C.

(57) ABSTRACT

An active control stick assembly is provided. In one embodiment, the active control stick assembly includes a housing assembly, and a control stick support body mounted within the housing assembly for rotation about two substantially orthogonal and co-planar rotational axes. A control stick is fixedly coupled to the control stick support body and rotatable along therewith from a null position to a plurality of control positions. A first spring element is coupled between the housing assembly and the control stick support body and passively biases the control stick toward the null position.

13 Claims, 3 Drawing Sheets

ACTIVE CONTROL STICK ASSEMBLY

TECHNICAL FIELD

The present invention relates generally to human-machine control interfaces and, more particularly, to an active control stick assembly suitable for deployment on an aircraft.

BACKGROUND

Modern aircraft are commonly equipped with one or more active control stick assemblies that permit a pilot to control various aspects of aircraft flight. An inceptor-type control stick assembly, for example, may be deployed on a fixed wing aircraft and utilized to control the aircraft's pitch and yaw. The inceptor-type control stick assembly includes an elongated control stick that extends upward from a housing assembly mounted in the aircraft cockpit, typically in either a center stick or side stick disposition. The lower end of the control stick is affixed to a gimbal or double cardon assembly disposed within the housing assembly. The gimbal or double cardon assembly permits the control stick to be rotated relative to the housing assembly about first and second rotational axes (i.e., the pitch and roll axes). One or more position sensors are further disposed within the housing assembly and monitor control stick movement. During flight, the position sensors generate positions indicative of the control stick movement, which are subsequently utilized to alter the position of the aircraft's movable flight surfaces and thereby adjust the aircraft's pitch and yaw.

There has been a recent migration in the aircraft industry toward "active" control stick assemblies capable of providing tactile cueing; i.e., haptic force feedback imparted to the control stick indicative of the aircraft's current flight parameters. In general, such active control stick assemblies include at least one artificial force feel (AFF) motor (e.g., a brushless direct current motor) that is selectively energized by a controller. The AFF motor is mechanically coupled to the control stick by a speed reducer, which is conventionally either a gearbox or a harmonic drive. When energized by the controller, the AFF motor drives through the speed reducer to exert a controlled torque on the control stick about one or more of the rotational axis. In this manner, the active control stick assembly generates haptic force feedback, which may be varied by commands from the Flight Control Computers, commensurate with current aircraft attitude and flight conditions.

Although providing the pilot with feedback in a rapid and intuitive manner, conventional inceptor-type active control stick assemblies are limited in certain respects. The gimbal or double cardon architectures employed by such active control stick assemblies commonly employ a relatively large number of components, such as various brackets, bearings, and the like. As a result, such active control stick assemblies are often undesirably complex and costly to produce. In addition, such active control stick assemblies tend to be relatively bulky and may be difficult to integrate into the limited space available within an aircraft's cockpit.

Accordingly, it is desirable to provide an active control stick assembly suitable for deployment onboard an aircraft that eliminates the complex gimbal assemblies and double carbon arrangements employed by conventional control stick assemblies. Preferably, such an active control stick assembly would be less costly to produce, would have a reduced part count, and would have a streamlined envelope as compared to conventional control stick assemblies. Other desirable features and characteristics of the present invention will become apparent from the subsequent Detailed Description and the appended claims, taken in conjunction with the accompanying drawings and this Background.

BRIEF SUMMARY

An active control stick assembly is provided. In one embodiment, the active control stick assembly includes a housing assembly, and a control stick support body mounted within the housing assembly for rotation about two substantially orthogonal and co-planar rotational axes. A control stick is fixedly coupled to the control stick support body and rotatable along therewith from a null position to a plurality of control positions. A first spring element is coupled between the housing assembly and the control stick support body and passively biases the control stick toward the null position.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the invention or the application and uses of the invention. Furthermore, there is no intention to be bound by any theory presented in the preceding Background or the following Detailed Description.

Figure 1:
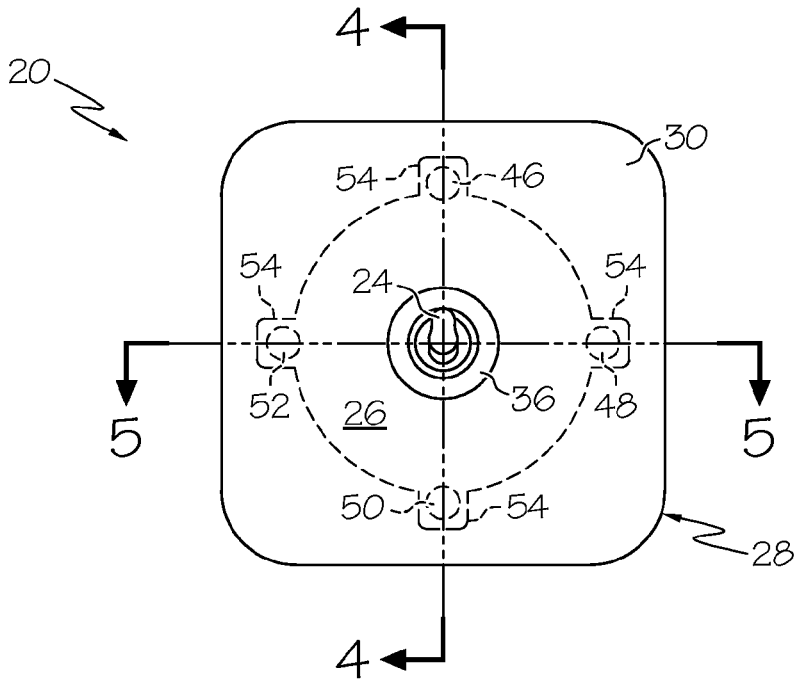
FIG. 1 is top plan view of an active control stick in accordance with a first exemplary embodiment.
Figure 2:
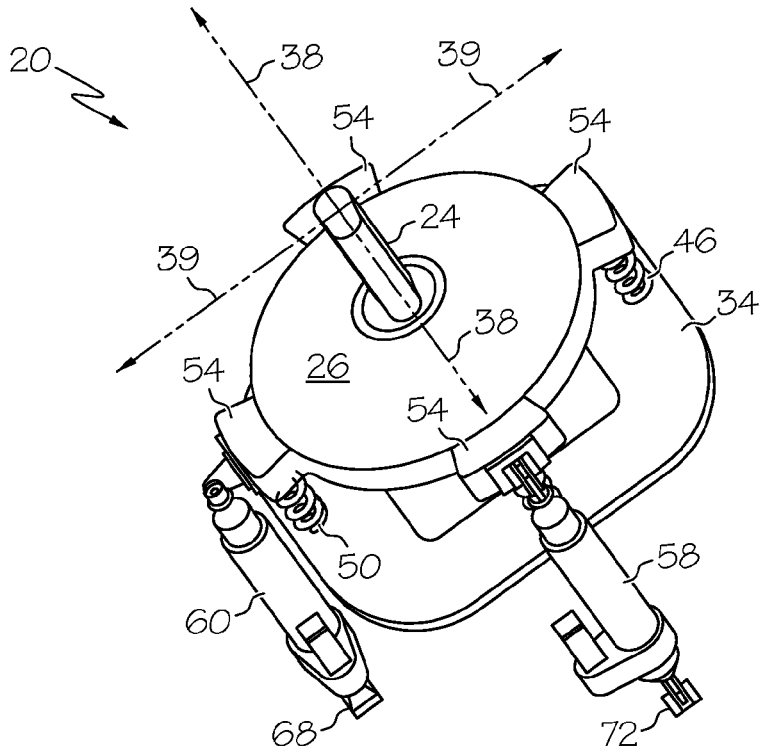
FIGS. 2 and 3 are top and bottom isometric views, respectively, of the active control stick shown in FIG. 1 having the cover removed for clarity.
Figure 3:
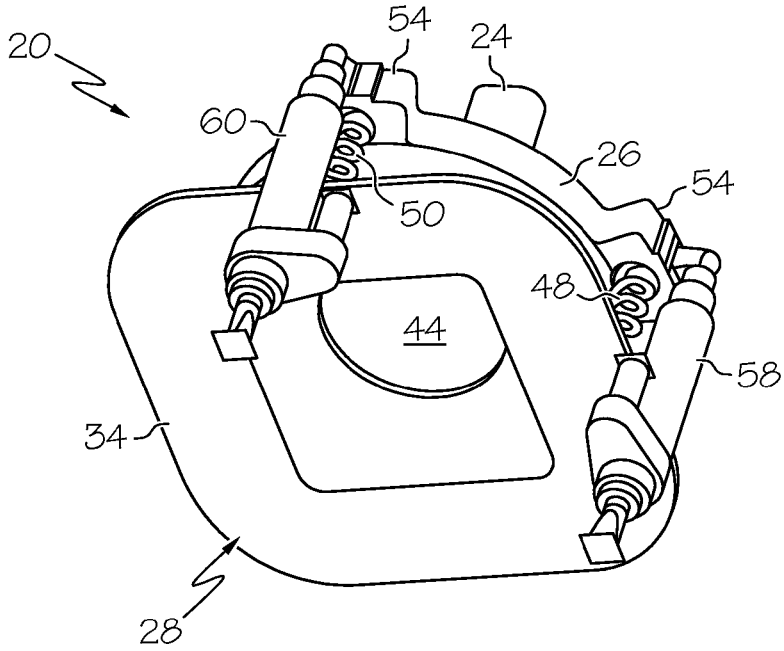

FIG. 1 is a top plan view of an active control stick assembly 20 in accordance with a first exemplary embodiment; and FIGS. 2 and 3 are upper and lower isometric views of active control stick assembly 20, respectively. In the exemplary embodiment shown in FIGS. 1-3 and described below, active control stick assembly 20 assumes the form of an inceptor-type control stick assembly commonly deployed within the cockpit of a fixed wing aircraft and utilized to control aircraft pitch and yaw. This example notwithstanding, alternative embodiments of the active control stick assembly may be deployed on other types of vehicles and machinery, such as excavation equipment, cranes, and the like.

Active control stick assembly 20 includes a control stick 24, which may assume the form of an elongated cylindrical body. Active control stick 20 is fixedly coupled (e.g., bolted) to an upper portion of a control stick support body 26 (shown in phantom in FIG. 1), which is rotatably mounted within a housing assembly 28. Housing assembly 28 may include any number of structural components suitable for supporting control stick support body 26 while permitting the rotational movement thereof. In the exemplary embodiment shown in FIGS. 1-3, housing assembly 28 includes a base 32 (shown in FIGS. 2 and 3), a cradle 34 (shown in FIGS. 2 and 3), and a cover 30 (shown in FIG. 1). Cradle 34 is fixedly coupled to base 32 and may be integrally formed therewith. Similarly, cover 30 is fixedly coupled to base 32 utilizing, for example, a plurality of bolts (not shown) or other such fasteners. As shown most clearly in FIG. 1, a central aperture 36 is provided through cover 30. Control stick 24, and perhaps an upper portion of control stick support body 26, extends through aperture 36 so as to be manually accessible from the exterior of housing assembly 28.

Control stick support body 26 is mounted within housing assembly 28 for rotation about first and second rotational axes 38 and 39 (labeled in FIG. 2), which are preferably substantially orthogonal and co-planar. As noted above, control stick 24 is affixed to an upper portion of control stick support body 26. Control stick 24 may thus also rotate along with control stick support body 26 about rotational axes 38 and 39. Control stick 24 and control stick support body 26 normally reside in a null position (illustrated in FIGS. 1-3). During operation, a pilot selectively rotates control stick 24, and therefore support body 26, about rotational axes 38 and 39 from the null position to a plurality of control positions to control various aspects of aircraft flight. When control stick assembly 20 assumes the form of an aircraft inceptor, first and second rotational axes 38 and 39 may correspond to an aircraft's pitch and roll axes, respectively. In this case, control stick assembly 20 may be mounted such that control stick support body 26 rotates: (i) about first rotational axis 38 as a pilot moves control stick 24 in a left or right direction, and (ii) about second rotational axis 39 as a pilot moves control stick 24 in a forward or aft direction. Control stick assembly 20 further permits control stick 24 to be moved in a combined forward-left direction, a combined forward-right direction, a combined aft-left direction, or a combined aft-right direction, and back to or through the null position. In a preferred embodiment, control stick 24 is mounted to control stick support body 26 such that the longitudinal axis of control stick 24 is substantially perpendicular to rotational axes 38 and 39 when in the null position; however, control stick 24 may also be mounted to control stick support body 26 in a manner such that the longitudinal axis of control stick 24 is either offset relative to the intersection of the two rotational axes and/or angled with respect to one or both of the rotational axes.

Figure 4:
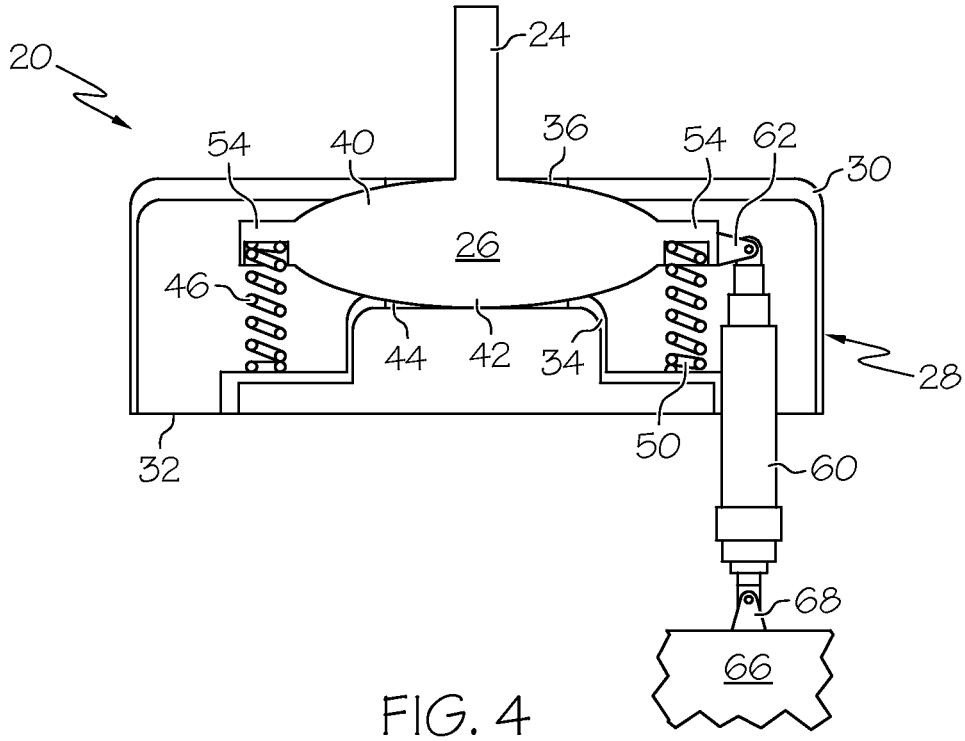
FIGS. 4 and 5 are plan cross-sectional views of the active control stick shown in FIGS. 1 and 2 taken along lines 4-4 and 5-5, respectively, as labeled in FIG. 1.
Figure 5:
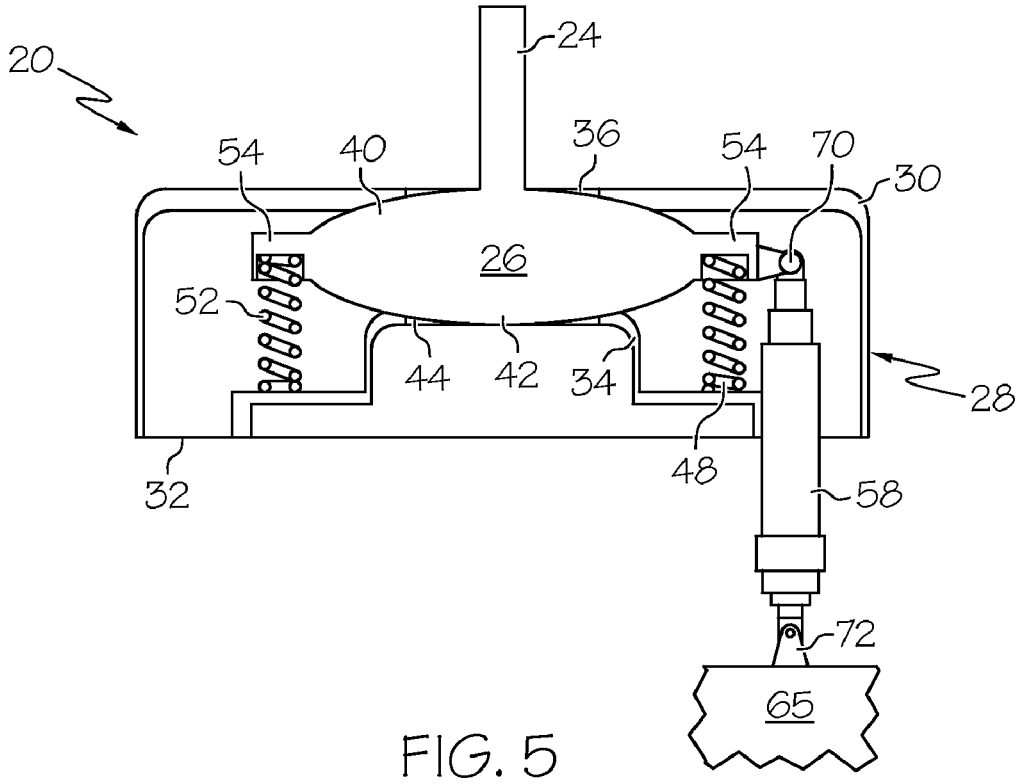

FIGS. 4 and 5 are plan cross-sectional views of control stick assembly 20 taken along lines 4-4 and 5-5, respectively, as labeled in FIG. 1. In FIGS. 4 and 5, it can be seen that cradle 34 and cover 30 cooperate to define a socket in which control stick support body 26 resides. Although control stick support body 26 may assume a variety of geometries, it is preferred that control stick support body 26 assumes a generally spherical shape, such as the shape of a perfect sphere, a flattened sphere, or other such sphere. In the exemplary embodiment illustrated in FIGS. 4 and 5, control stick support body 26 assumes the shape of a flattened sphere. In this case, control stick support body 26 may include generally convex or domed upper and lower portions 40 and 42. When control stick assembly 20 is assembled, domed lower portion 42 seats within a guide feature provided in, on, or through cradle 34. This guide feature may comprise, for example, a concavity or other such depression that matingly receives domed lower portion 42 therein. Alternatively, and as shown in FIGS. 4 and 5, the guide feature may comprise an opening 44 provided through a central portion of cradle 34. The inner edge of cradle 34 defining opening 44 contacts domed lower portion 42 to guide the rotational movement of control stick support body 26 and to generally prevent lateral movement of support body 26 within housing assembly 28. If desired, the inner edge of cradle 34 defining central opening 44 may have a tapered or sloped geometry to better mate with the curved outer surface of domed lower portion 42.

In the illustrated exemplary embodiment, cover 30 also contacts control stick support body 26 to guide the rotational movement thereof. More specifically, the inner edge of cover 30 defining aperture 36 contacts domed upper portion 40 of control stick support body 26 to guide the rotational movement thereof. Again, the inner edge of cover 30 defining aperture 36 may have a tapered or sloped shape to better mate with the sloped outer surface of domed upper portion 40. As does the inner edge of cradle 34 defining opening 44, the inner edge of cover 30 defining aperture 36 generally prevents lateral movement of support body 26 within housing assembly 28. Furthermore, the inner edge of cradle 34 cooperates with the inner edge of cover 30 to generally prevent the vertical movement of control stick support body 26 within housing assembly 28. In this manner, cradle 34 and cover 30 cooperate to restrict the movement of control stick support body 26, and therefore the movement of control stick 24, to rotational movement about rotational axes 38 and 39 (FIG. 2). This example notwithstanding, it will be appreciated that alternative embodiments of control stick assembly 20 may include other types of guide features suitable for restricting the movement of control stick support body 26 in this manner.

Control stick assembly 20 further includes one or more spring element mechanically coupled between control stick support body 26 and housing assembly 28. The number, type, and orientation of the spring element or elements employed by control stick assembly 20 will inevitably vary amongst different embodiments of the present invention. In the exemplary embodiment illustrated in FIGS. 1-5, control stick assembly 20 comprises four coil springs 46, 48, 50, and 52, which are each disposed between a component of housing assembly 28 and control stick support body 26. More specifically, coil springs 46, 48, 50, and 52 each include a first end portion, which is fixedly coupled to an outer step provided around cradle 34, and a second opposing end portion, which is fixedly coupled to a peripheral portion of control stick support body 26; e.g., an end portion of each coil spring 46, 48, 50, and 52 may be fixedly coupled to a different radial flange 54 angularly spaced about a circumferential portion of control stick support body 26. If desired, an annular depression may be provided within each radial flange 54 to help retain springs 46, 48, 50, and 52 in place. As may be appreciated most easily by referring to FIG. 1, springs 46, 48, 50, and 52 are preferably positioned such that each spring is substantially equidistant from the longitudinal axis of control stick 24 when in the null position. Collectively, coil springs 46, 48, 50, and 52 passively bias control stick support body 26, and thus control stick 24, toward the null position shown in FIGS. 1-5.

Control stick assembly 20 further includes first and second artificial force feel (AFF) actuators 58 and 60. AFF actuators 58 and 60 are each mechanically coupled between control stick support body 26 and a stationary mounting structure generally referred to herein as "the aircraft chassis." For example, and referring especially to FIG. 4, a first end of AFF actuator 60 may be coupled to a radial flange 54 of control stick support body 26 via a first hinged coupling 62 (e.g., a first clevis), and the opposing end of AFF actuator 60 may be coupled to a first chassis mounting structure 66 via a second hinged coupling 68 (e.g., a second clevis). Similarly, and with reference to FIG. 5, a first end of AFF actuator 58 may be coupled to a radial flange 54 of control stick support body 26 via a third hinged coupling 70 (e.g., a third clevis), and the opposing end of AFF actuator 58 may be coupled to a second chassis mounting structure 65 via a fourth hinged coupling 72 (e.g., a fourth clevis). When coupled between control stick support body 26 and the aircraft chassis in this manner, AFF actuators 58 and 60 reside adjacent coil springs 48 and 50, respectively, and the longitudinal axes of AFF actuators 58 and 60 are substantially parallel. AFF actuators 58 and 60 may be implemented utilizing any suitable hydraulic or pneumatic device, although it is preferred that AFF actuators 58 and 60 each comprise an electric device, such as a ballscrew actuator. During operation, a controller selectively energizes (or otherwise activates) first and second AFF actuators 58 and 60 to provide haptic force feedback to control stick 24 about rotational axes 38 and 39, respectively, in accordance with commands issued from one or more Flight Control Computers deployed on the aircraft and commensurate with current aircraft attitude and flight conditions.

Figure 6:
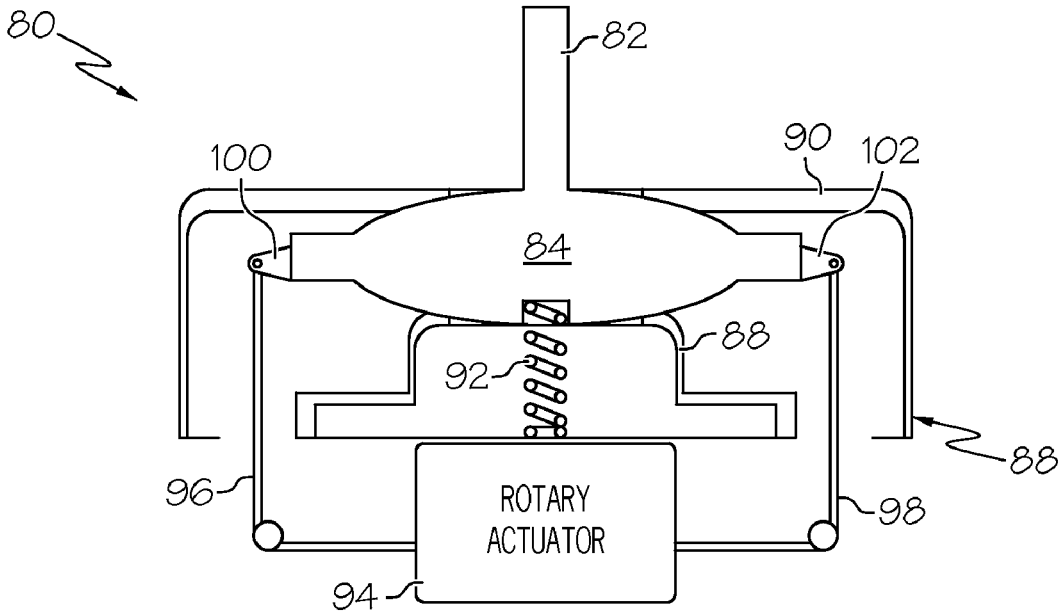
FIG. 6 is a plan cross-sectional view of an active control stick in accordance with a second exemplary embodiment.

It should thus be appreciated that there has been provided an exemplary embodiment of an active control stick assembly that includes a plurality of coils springs angularly spaced about a peripheral portion of a control stick support body rotatably mounted within a housing assembly. It should also be appreciated that, in the above-described exemplary embodiment, first and second linear actuators are employed to impart haptic force feedback to the control stick support body and, thus, the control stick. The foregoing notwithstanding, alternative embodiments of the active control stick assembly may employ other types of actuator and different arrangements of the spring element or elements. Further illustrating this point, FIG. 6 is a simplified cross-sectional view of an active control stick assembly 80 in accordance with a second exemplary embodiment. In many respects, control stick assembly 80 is similar to control stick assembly 20 described above in conjunction with FIGS. 1-5. For example, active control stick assembly 80 includes an elongated control stick 82 that is fixedly coupled (e.g., bolted) to the upper portion of a control stick support body 84 rotatably disposed within a housing assembly 86. As was the case previously, housing assembly 86 includes a cradle 88 and a cover 90 that engage opposing portions of control stick support body 84 to generally restrict the movement of support body 84, and therefore the movement of control stick 82, to rotational about two substantially orthogonal rotational axes. However, in contrast to control stick assembly 20 (FIGS. 1-5), control stick assembly 80 (FIG. 6) does not include a plurality of spring elements coupled between an outer peripheral portion of control stick support body 84 and housing assembly 86. Instead, control stick assembly 80 includes a single element, a coil spring 92, which is mechanically coupled between a central portion of control stick support body 84 and housing assembly 86. If desired, and as indicated in FIG. 6, an annular depression may be provided within a lower portion of control stick support body 84 to help retain coil spring 92 in place. During operation of control stick assembly 80, coil spring 92 passively biases control stick support body 84 and control stick 82 toward a null position illustrated in FIG. 6.

In addition to employing a single, centrally-coupled spring element, control stick assembly 80 differs from control stick assembly 20 (FIGS. 1-5) in another manner as well; i.e., control stick assembly 80 employs one or more rotary actuators 94, as opposed to one or more linear actuators, to provide active force feedback to control stick 82. As shown in FIG. 6, a first rotary actuator 94 is mechanically linked to opposing end portions of control stick support body 84 via first and second cables 96 and 98. For example, cable 96 may be rotatably coupled to support body 84 utilizing a first clevis 100, and cable 98 may be rotatably coupled to an opposing end of support body 84 utilizing a second clevis 102. During operation, a controller (not shown) causes rotary actuator 94 to selectively retract and let out cables 96 and 98 to impart controlled torque about control stick support body 84 about a first rotational axis and thereby provide haptic force feedback to control stick 82. Although not shown in FIG. 6 for clarity, a second rotary actuator may also be mechanically linked to support body 84 and configured to impart torque to support body 84 about a second rotational axis, which is substantially orthogonal to and coplanar with the first rotational axis, to further provide haptic force feedback to control stick 82 in the above-described manner.

It should thus be appreciated that there has been provided multiple exemplary embodiments of an active control stick assembly suitable for deployment on an aircraft that eliminates the complex gimbal assemblies and double carbon arrangements employed by conventional control stick assemblies. It should further be appreciated that the embodiments of the active control stick assembly are generally less costly to produce, have a reduced part count, and have a more compact envelope as compared to conventional control stick assemblies. Although, in the above-described embodiments, the spring elements each assumed the form of a coil spring, this may not always be the case; in alternative embodiments, the spring elements may assume other forms suitable for passively biasing the control stick support body toward the null position. For example, in certain embodiments, one or more of the spring elements may assume the form of a resilient metal body having or more slits therethrough and commonly referred to as machined spring. Alternatively, leaf springs and torsional springs or bars may also be employed.

While at least one exemplary embodiment has been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as set-forth in the appended claims.

What is claimed is:

1. An active control stick assembly, comprising:

a housing assembly, comprising:

a cradle having an opening therethrough;

a cover fixedly coupled to the cradle;

a control stick support body mounted within the housing assembly for rotation about two substantially orthogonal and co-planar rotational axes, the control stick support body having a domed lower portion seating on the opening in the cradle;

a control stick fixedly coupled to the control stick support body and rotatable along therewith from a null position to a plurality of control positions, the control stick extending from the control stick support body through the cover; and a centrally-disposed spring element coupled between the housing assembly and the control stick support body and passively biasing the control stick toward the null position, the centrally-disposed spring element engaging the domed lower portion of the control stick support body exposed through the opening in the cradle.

2. An active control stick assembly according to claim 1 wherein the first spring element comprises:

a first end portion fixedly coupled to the housing assembly; and a second end portion substantially opposite the first end portion and fixedly coupled to a lower surface of the control stick support body.

3. An active control stick assembly according to claim 1 wherein the upper portion of the control stick support body has a generally domed shape, and wherein the cover includes a sloped inner edge defining an opening through which the control stick extends, the sloped inner edge contacting the upper portion so as to generally prevent the lateral movement of the control stick support body and the control stick.

4. An active control stick assembly according to claim 1 further comprising a first artificial force feel (AFF) actuator coupled to the control stick support body and configured to selectively supply a torque to the control stick support body about the first rotational axis.

5. An active control stick assembly according to claim 4 further comprising a second AFF actuator coupled to the control stick support body and configured to selectively supply a torque to the control stick support body about the second rotational axis.

6. An active control stick assembly according to claim 5 wherein the active control stick assembly is configured to deployed on an aircraft, and wherein the first AFF actuator and the second AFF actuator cooperate to provide active force feedback to the control stick indicative of at least one flight parameter of the aircraft.

7. An active control stick assembly according to claim 1 wherein the control stick support body has a generally spherical shape.

8. An active control stick assembly, comprising:

a housing assembly, comprising:

a cradle; and a cover fixedly coupled to the cradle and having a central opening therethrough;

a control stick extending through the central opening;

a generally spherical control stick support body rigidly coupled to the control stick and disposed between the cradle and the cover, the generally spherical control stick support body mounted within the housing assembly for rotation about two substantially orthogonal rotational axes so as to permit the control stick to be rotated from a null position to a plurality of control positions; and a first spring element coupled between the housing assembly and the generally spherical control stick support body and passively biasing the control stick toward the null position;

wherein the cradle has a sloped inner circumferential edge on which the generally spherical control stick support body seats, the sloped inner circumferential edge of the cradle and the central opening provided in the cover cooperating to define a socket occupied by the spherical control stick support body.

9. An active control stick assembly according to claim 8 wherein the control stick support body comprises:

a first radial flange, the first spring element compressed between the first radial flange and the housing assembly; and a second radial flange angularly spaced from the first radially flange.

10. An active control stick assembly according to claim 9 further comprising a second spring element compressed between the second radial flange and the housing assembly.

11. An active control stick assembly according to claim 10 further comprising:

a first artificial force feel (AFF) actuator hingedly to the first radial flange, the first spring element disposed between the first AFF actuator and the spherical control stick support body; and a second AFF actuator hingedly coupled to the second radial flange, the second spring element disposed between the second AFF actuator and the spherical control stick support body.

12. An active control stick assembly according to claim 11 wherein the first AFF actuator and the second AFF actuator are disposed proximate the first spring element and the second spring element, respectively.

13. An active control stick assembly according to claim 8 further comprising a rotary actuator mechanically linked to opposing end portions of the spherical control stick support body and configured to provide active force feedback to the control stick indicative of at least one flight parameter of the aircraft.

* * * * *